US007157152B2

(12) United States Patent
Urata et al.

(10) Patent No.: US 7,157,152 B2
(45) Date of Patent: Jan. 2, 2007

(54) COPPER-TIN-OXYGEN ALLOY PLATING

(75) Inventors: Kazuya Urata, Saitama (JP); Kazuhiro Kitagawa, Saitama (JP); Yukio Ogawa, Saitama (JP); Kenji Hasegawa, Tokyo (JP)

(73) Assignees: Nihon New Chrome Co., Ltd., Tokyo (JP); YKK Snap Fasteners Japan Co., Ltd., Tokyo (JP)

( * ) Notice: Subject to any disclaimer, the term of this patent is extended or adjusted under 35 U.S.C. 154(b) by 0 days.

(21) Appl. No.: 10/517,691

(22) PCT Filed: Jun. 12, 2003

(86) PCT No.: PCT/JP03/07484

§ 371 (c)(1),
(2), (4) Date: Dec. 8, 2004

(87) PCT Pub. No.: WO03/106739

PCT Pub. Date: Dec. 24, 2003

(65) Prior Publication Data

US 2005/0208314 A1 Sep. 22, 2005

(30) Foreign Application Priority Data

Jun. 13, 2002 (JP) ..... 2002-173078

(51) Int. Cl.
*B32B 15/00* (2006.01)
*A44B 17/00* (2006.01)
*C25D 7/00* (2006.01)

(52) U.S. Cl. ..... 428/639; 428/646; 428/674; 428/469; 428/935; 24/1

(58) Field of Classification Search ..... 428/469
See application file for complete search history.

(56) References Cited

U.S. PATENT DOCUMENTS

| | | | | |
|---|---|---|---|---|
| 3,649,254 | A * | 3/1972 | Servi | 420/470 |
| 4,710,441 | A * | 12/1987 | Ritchie et al. | 430/62 |
| 5,972,526 | A * | 10/1999 | Matsumoto et al. | 428/644 |
| 6,312,762 | B1 * | 11/2001 | Sugawara et al. | 427/376.2 |
| 6,336,979 | B1 * | 1/2002 | Sugawara et al. | 428/908.8 |
| 6,416,571 | B1 | 7/2002 | Kaneko et al. | |

FOREIGN PATENT DOCUMENTS

| | | | |
|---|---|---|---|
| DE | 10243139 | A1 * | 3/2004 |
| EP | 1026287 | A1 * | 8/2000 |
| EP | 1066895 | A2 | 10/2001 |
| JP | 59-023895 | * | 2/1984 |
| JP | 1011996 | | 1/1989 |
| JP | 01-113001 | * | 5/1989 |
| JP | 07-246562 | * | 9/1995 |
| JP | 10102278 | | 4/1998 |
| JP | 2002298963 | | 10/2002 |

OTHER PUBLICATIONS

A Dictionary of Metallurgy, Merriman, 1958, "Alloy", p. 5.*
WEBSTER'S New Collegiate Dictionary, 1977, "plating", p. 880.*

* cited by examiner

*Primary Examiner*—John J. Zimmerman
(74) *Attorney, Agent, or Firm*—Dennis G. LaPointe

(57) ABSTRACT

The present invention relates to a Cu—Sn—O alloy plating having an oxygen content of 0.3 to 50 at %, a copper content of 20 to 80 at %, and a tin content of 10 to 70 at % in the plating. The present invention provides a copper tin alloy plating that has excellent plating adhesion and disengaging force stability and particularly a Cu—Sn—O alloy plating that has a blackish color tone without containing any controlled substances.

13 Claims, 1 Drawing Sheet

COPPER-TIN-OXYGEN ALLOY PLATING

TECHNICAL FIELD

The present invention relates to a copper-tin alloy plating used on ornamental articles for use in clothing, such as broaches, buttons, buckles, fasteners and cuff buttons, accessories such as a necklace or an earring, toys, and other industrial goods. More particularly, the present invention relates to a copper-tin-oxygen alloy plating (hereinafter, referred to as Cu—Sn—O alloy plating) that has excellent plating adhesion and excellent disengaging power stability described hereinbelow and has a black or black-based color without containing any controlled substances.

BACKGROUND ART

Clothing manufacturers are concerned about the danger that needles used for sewing clothes, bags, pouches, etc., if they are left to remain in the products, could prick the human body and to prevent such danger, magnetic inspection for detecting needles has been conducted. Accordingly, non-magnetic plating, for example, nickel-phosphorus plating or nickel-tin alloy plating has been predominantly used for ornamental articles for clothing. However, in recent years, it has been pointed out that if nickel-containing metal contacts a human body, it can be an allergen to cause skin rashes or inflammation. Several countries in the world, such as European countries and the United States of America, are going to take some measures (legislation) for protecting the human body from such a nickel allergy.

Under the circumstances, copper-tin alloy plating has been reviewed in recent years as promising metal plating that substitutes for nickel alloy plating.

Many techniques have hitherto been proposed for copper-tin alloy plating as disclosed in JP 10-102278 A, JP 2001-295092A (U.S. Pat. No. 6,416,571), etc. However, the conventional techniques have a problem of instability of a disengaging force. That is, when the conventional technique is applied to ornamental articles like snap buttons, which are attached to clothes and repeatedly subject to resilient snap engagement, fluctuation of the disengaging force (i.e. force required for disengaging a snap engagement) becomes greater as engagement and disengagement are repeated, and eventually the disengaging force will be outside of a specific range. As a result, when the disengaging force is too strong, the cloth will be ruptured and on the contrary when the disengaging force is too weak, the button will be disengaged of itself. Note that as shown in FIG. 1, which is a cross-sectional view showing a snap button, the snap button includes snaps used as a set, i.e., a male snap 1 consisting of a stud member 3 having a round head 3*a* that has a generally extended (flared) top and a fitting member 4 for fitting the stud member 3 to a cloth 7, and a female snap 2 having a socket member 5 resiliently engageable with the round head 3*a* of the male snap 1 and a fitting member 6 for fitting the socket member 5 to another cloth 8.

Further, when copper-tin alloy plating is applied to clothing ornaments, accessories or the like, the appearance color (color tone) of the plating is considered to be one of the important qualities required. In the copper-tin alloy plating, those platings having a red, yellow (gold), white, or silver white color tone have been realized by varying the contents of copper and of tin in the plating and on the other hand those platings having a black-based color tone have been realized by incorporating cobalt or selenium in the copper-tin plating.

However, since the use amounts of cobalt and selenium in the copper-tin-(cobalt or selenium) alloy in the plating having a black-based color tone are regulated by European Toy Safety Standard EN71-3 or Ecotex Standard 100, copper-tin alloy plating having a black-based color tone without containing any such controlled substances has been demanded.

As far as is known, there has been made only one proposal for the copper-tin alloy plating having a black-based color tone containing no such prohibited substance. That is, JP 10-102278 A discloses a method of producing copper-tin alloy plating having a pale black color tone with a Cu/Sn weight ratio=41/59. The black plating taught in the document has poor disengaging force stability and poor adhesion. As a result, a problem arises, for example, that the plating migrates to the clothes by friction with the clothes, so that the commercial value of the clothes is deteriorated, which prevents commercialization of the above-mentioned pale black copper-tin alloy plating.

Further, industrially operative plating having a black-based color tone for ornamentation and corrosion resistance includes nickel-tin alloy. However, the plating has poor adhesion so that its disengaging force stability is poor and, further, it causes a problem of nickel allergy.

DISCLOSURE OF THE INVENTION

Therefore, an object of the present invention is to provide a copper-tin alloy plating having excellent plating adhesion and excellent disengaging force stability and more particularly a Cu—Sn—O alloy plating having a black-based appearance without containing any controlled substances.

The present inventors have made extensive studies on the compositions of plating and qualities (the disengagement stability, plating adhesion, corrosion resistance, and color tone of plating) of copper-tin alloy platings and as a result, they have found that incorporation of a specified amount of oxygen in the plating to produce Cu—Sn—O alloy plating provides an alloy plating that not only has excellent disengaging force stability without deteriorating plating adhesion and corrosion resistance but also has a black-based color tone, thereby achieving the present invention.

That is, the present invention is composed of the following.

1. A Cu—Sn—O alloy plating having an oxygen content of 0.3 to 50 at % in the plating.
2. The Cu—Sn—O alloy plating as described in 1 above, wherein the oxygen content is 0.5 to 47 at %.
3. The Cu—Sn—O alloy plating as described in 1 above, wherein the oxygen content is 1.5 to 50 at % and the plating has blackish appearance.
4. The Cu—Sn—O alloy plating as described in any one of 1 to 3 above, wherein a copper content is 20 to 80 at %, and a tin content is 10 to 70 at % in the plating.
5. An ornamental article having Cu—Sn—O alloy plating as described in any one of 1 to 4 above.
6. The ornamental article as described in 5 above, wherein the article is a snap button.

DETAILED DESCRIPTION OF THE INVENITON

Figure 1:
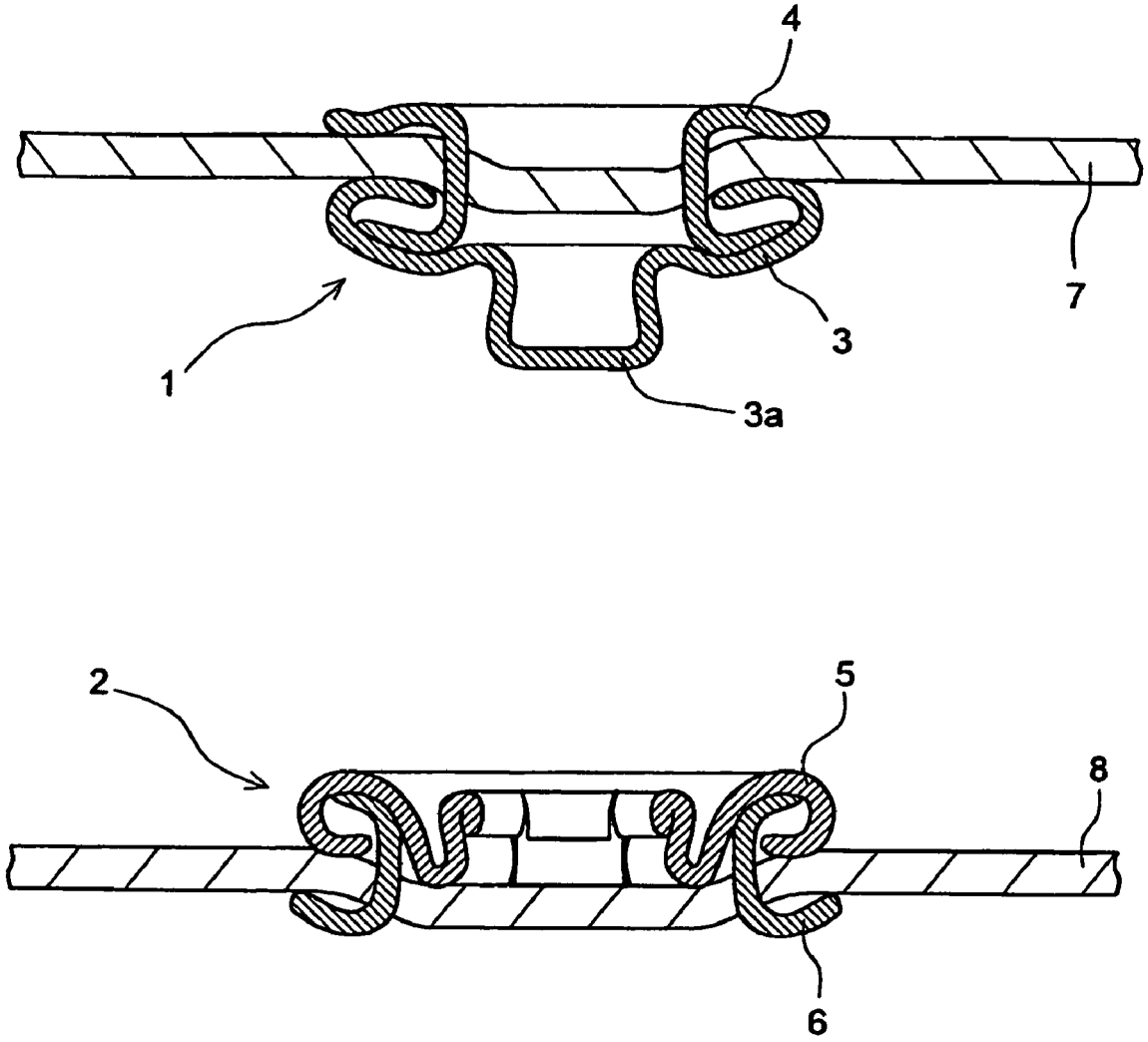
FIG. 1 is an explanatory cross-sectional view showing a snap button.

Hereinafter, the present invention will be described in detail with reference to the attached drawing.

According to the present invention, it has been found that in order to achieve plating adhesion, corrosion resistance, and disengaging force stability as desired, it is essential to adjust the content of oxygen in the Cu—Sn—O alloy plating to 0.3 to 50 at %.

In the present invention, the means for incorporating oxygen into a plating is not particularly limited. A preferred method of incorporating oxygen into a plating includes a method in which plating is performed in a plating bath containing, for example, an oxidizing agent and/or an additive such as a special surfactant (for example, trade name: Top Rinse, manufactured by Okuno Chemical Industry Co., Ltd.).

The reason why the incorporation of oxygen into a copper-tin alloy plating in a content of 0.3 to 50 at % improves disengaging force stability of the plating is not clear. However, it may be presumed that due to oxides formed therein, (1) the hardness of the plating is increased and (2) fine unevenness is formed on the surface of the plating to decrease a contact area of the portions where the male and female engagement members contact each other, thereby increasing lubricity and decreasing friction coefficient and other complex effects. Such complex effects may result in prevention of the occurrence of galling between the male and female members and/or reduction in abrasion of the plating.

If the oxygen content in the plating is less than 0.3 at %, the Cu—Sn—O plating has an increased metallic property so that excellent disengaging force stability as aimed at by the present invention cannot be obtained. On the other hand, if the oxygen content in the plating is above 50 at %, the Cu—Sn—O alloy plating is mostly constituted by oxides so that the plating adhesion becomes poor and also the disengaging force stability is decreased. To obtain particularly excellent disengaging force stability and plating adhesion, it is preferred that the oxygen content of the plating is within a range of 0.5 to 47 at % and more preferably 1.0 to 37 at %.

Further, by containing the oxygen at a content of 1.5 at % or more, more preferably 3 at % or more, and most preferably 5 at % or more, the plating can obtain a black-based appearance (blackish color). Only from the viewpoint of the color tone of the plating, an increased oxygen content in the plating can lead to an increase in blackishness and hence the oxygen content in the plating may be selected as appropriate depending on the intended application. However, as described above, increasing the oxygen content in the plating excessively causes the disengaging force stability and plating adhesion to become deteriorated. In the present invention, the oxygen content for providing a plating having a black-based color tone and excellent disengaging force stability and plating adhesion of the plating is preferably 1.5 to 50 at %, more preferably 3 to 47 at %, and most preferably 5 to 37 at %.

Note that the black-based color tone referred to herein can be evaluated by various methods. For example, it can be evaluated by the Hunter brightness index (L value) ($L=10\times Y^{1/2}$) (where Y is one of three stimulation values (variables) prescribed in JIS-Z-8722). The black-based color tone corresponds to one having an L value of 87 or less.

In the present invention, it is preferred that the copper content in the plating is within a range of 20 to 80 at % and the tin content in the plating is within a range of 10 to 70 at %. If the copper content in the plating is less than 20 at % or the tin content in the plating exceeds 70 at %, the hardness of the plating is excessively decreased to provide a plating having poor disengaging force stability. On the other hand, if the copper content in the plating exceeds 80 at % or the tin content in the plating is less than 10 at %, the hardness of the plating becomes excessively high so that the plating becomes brittle and both adhesion and corrosion resistance become poor.

Further, in the case of the copper-tin-oxygen alloy plating having a black-based color tone, adjustment of the copper and tin contents in the plating achieves color variation, for example, reddish black, grayish black, bluish black, greenish black, yellowish black or the like.

More preferred copper and tin contents are a copper content of 30 to 75 at % and a tin content of 15 to 60 at %.

The Cu—Sn—O alloy plating of the present invention may contain components other than copper, tin and oxygen in small amounts so far as they do not give adverse influences on the quality of the plating. That is, the Cu—Sn—O alloy plating of the present invention may contain components derived from raw material water for a plating solution, such as calcium, silicon and chlorine and those components derived from plating auxiliaries such as a brightener, for example, carbon, nitrogen, sulfur, phosphorus and the like in small amounts so far as such components do not adversely affect the quality of the platings.

In the present invention, the content ratio of copper, tin, and oxygen atoms are based on the results of compositional analysis in the direction of the depth of the plating by an Auger electron spectroscopy (hereinafter referred to as the Auger method). However, the outermost surface of the plating tends to fail to give exact analytical values with satisfactory reproducibility owing to effects such as natural oxidation and surface contamination, so that the analytical values obtained on the outermost surface are excluded in the present invention. That is, those analytical values obtained on a portion that is less susceptible to natural oxidation, surface contamination and the like and also to a change in the composition of the plating with time are adopted as content values of copper, tin, and oxygen atoms. Usually, analytical values of a portion at a depth of 10 nm or more (a value derived from the sputtering rate and sputtering time) from the outermost surface toward inside (toward the direction to substrate) are used.

According to one embodiment of the present invention, the Cu—Sn—O alloy plating of the present invention only needs to be applied onto a substrate as an outermost plating layer and may be used either for a single layer plated product or for a multilayer plated product. Specifically, it is possible to produce a plated product that includes a substrate on which only one alloy plating of the present invention is applied or a plated product that includes a substrate that has thereon also at least one metal plating layer such as nickel plating, nickel alloy plating, copper plating, copper alloy plating, zinc plating, zinc alloy plating, tin plating, tin alloy plating or the like as an under layer below the Cu—Sn—O alloy plating so far as such does not harm the quality and performance of the plating. It is also possible to produce a multilayer plated product in which a plurality of plating layers of the same Cu—Sn—O alloy are laminated on a substrate.

The substrate (article to be plated) that can be used in the present invention is not particularly limited and may be selected as appropriate depending on the use. Examples of such a substrate include: metal materials such as iron, steel, copper, brass and the like copper alloys; ceramic materials or plastic materials; or articles made of ceramic or plastic materials on which some metal plating has been applied in advance.

The thickness of the plating is not particularly limited and may be selected as appropriate depending on the intended use. It is desirable that the thickness of the plating is 0.05 μm or more. If the thickness of the plating is less than 0.05 μm, the quality and performance of the plating of the present invention cannot be obtained.

Further, the Cu—Sn—O alloy plating of the present invention may have formed thereon a film of varnish or coating composition in order to further improve the design aesthetics and corrosion resistance of the plating.

As described above, in the Cu—Sn—O alloy plating of the present invention, a suitable amount of oxygen (0.3 to 50 at %) contained in the plating contributes to obtaining excellent plating adhesion, corrosion resistance and disengaging force stability. Further, adjusting the oxygen content to a specific range (1.5 to 50 at %) can provide a Cu—Sn—O alloy plating having a black-based color tone.

The plated product of the present invention can be produced, for example, by a method involving a conventional plating process using a plating bath having compounded therein the above-mentioned special surfactant component.

The process for producing plated products according to the present invention includes, for example, in the case of a single layer plating, degreasing treatment (immersion degreasing and/or electrolytic degreasing)→rinsing with water→acid activation treatment→rinsing with water→plating treatment→rinsing with water→drying (cf. Example 1 described hereinbelow for details). Further, in the case of a two layer plating, the process includes degreasing treatment (immersion degreasing and/or electrolytic degreasing)→rinsing with water→acid activation treatment→rinsing with water→plating treatment→rinsing with water→acid activation treatment→rinsing with water→plating treatment→rinsing with water→drying (cf. Examples 2 and 16 described hereinbelow for details), alternatively, the process includes degreasing treatment (immersion degreasing and/or electrolytic degreasing)→rinsing with water→acid activation treatment→rinsing with water→plating treatment→rinsing with water→plating treatment→rinsing with water→drying (cf. Example 17 described hereinbelow for details). However, the present invention is not limited to the above-mentioned processes. For example, post-treatment step such as chemical forming treatment and coating treatment, baking step and the like during the plating process may be combined as appropriate or acid activation treatment, degreasing treatment, rinsing with water or the like may be omitted or added as appropriate.

Examples of the means for performing plating treatment that can be used in the present invention include known plating techniques such as electroless plating and electroplating as typified by barrel plating, rack plating, and high speed plating.

The plating of the present invention can be used advantageously as a plating, particularly for ornamental articles for clothing as typified by buttons, buckles, slide fasteners, and cuff buttons, accessories such as earrings and necklaces as well as toys and other industrial goods for providing corrosion resistance or ornamentation thereto. However, the present invention is not limited thereto and can also be used for electronic parts.

Since the Cu—Sn—O alloy plating of the present invention has excellent disengaging force stability, it can be used preferably for use in costumery, in particular, as plating for snap buttons.

BEST MODE FOR CARRYING OUT THE INVENTION

Hereinafter, the present invention will be explained by examples and comparative examples. However, the present invention should not be considered to be limited by the following description.

The copper content, tin content and oxygen content of a plated product in the examples and comparative examples were obtained by performing analyses by an Auger electron spectroscopy in the depth direction under the following measuring conditions and values after sputtering for 5 minutes were adopted for analysis.

[Measuring Conditions]

Apparatus: PHI-660 (manufactured by Physical Electronics)

<Electron Beam Condition>

Accelerating voltage: 5 kV

Irradiation current: 0.5 μA

Measuring region: 200×200 $\mu m^2$

<$Ar^+$ Sputtering Condition>

Accelerating voltage: 3 kV

Sputtering region: 2×2 $mm^2$

Sputtering speed: 11 nm/min (found value for $SiO_2$)

The appearance (color) of the plating was evaluated in the following manner. When the ornamental article in each of examples and comparative examples was placed in a barrel to carry out plating, simultaneously, one brass plate of 25 mm×25 mm was placed in a barrel to be plated, and L value of each plated brass was measured under the following conditions (note that the composition of the plating on the brass sample was the same as the composition of the plating on the ornamental article plated in respective Example and Comparative Examples, and the appearance (color) was the same as well).

Apparatus: touch panel type SM Color Computer (Model SM-T), manufactured by Suga Test Instruments Co., Ltd.

Measuring condition: Illuminant C, 2 degree standard observer angle, Measuring diameter: Φ 15 mm Optical conditions: 8° illumination, receiving diffused light (8-D method)

Evaluation standards are described below.

◎: L value of less than 67

○: L value of 67 or more and less than 77

Δ: L value of 77 or more and less than 87 x: L value of 87 or more.

[Plating Bath]

The plating solutions used in the Examples and Comparative Examples are described below.

Plating Bath (1)

Potassium pyrophosphate: 300 g/l

Copper pyrophosphate: 0.6 g/l

Stannous pyrophosphate: 8 g/l

Methanesulfonic acid: 60 g/l

Glossing agent (reaction product of epichlorohydrin/anhydrous piperazine=1 mol/l mol): 0.015 g/l (as an effective ingredient)

Perfluoroalkyltrimethylammonium salt: 0.003 ml/l

Surfactant (trade name: Top Rinse, manufactured by Okuno Chemical Industry Co., Ltd.): 1 ml/l pH: 7.5

Plating Bath (2)

Potassium pyrophosphate: 300 g/l

Copper pyrophosphate: 0.6 g/l

Stannous pyrophosphate: 8 g/l

Methanesulfonic acid: 60 g/l

Glossing agent (reaction product of epichlorohydrin/anhydrous piperazine=1 mol/l mol): 0.015 g/l (as an effective ingredient)

Perfluoroalkyltrimethylammonium salt: 0.05 ml/l pH: 7.5

Plating Bath (3)

Stannous pyrophosphate: 23 g/l

Copper pyrophosphate: 7.5 g/l

Potassium pyrophosphate: 160 g/l

Glossing agent (reaction product of epichlorohydrin/anhydrous piperazine=1 mol/1 mol): 4 ml/l (0.712 g/l as an effective ingredient)

Glossing auxiliary agent (Paraformaldehyde): 0.5 to 1.0 g/l

Surface tension treatment agent (Acetyleneglycol): 0.04 g/l

N-benzylnicotinium hydrochloride: 1 to 2 ml/l p ratio (ration of '$P_2O_7$' to 'Sn+Cu'): 6.18 pH: 8.10

Plating Bath (4) (Commercially Available Tin Alkanesulfonate Plating Bath)

Ebasolder SN (based on organic acid and tin salt, manufactured by Ebara-Udylite Co., Ltd.): 100 g/l (10 g/l as tin)

Ebasolder A (based on organic acid, manufactured by Ebara-Udylite Co., Ltd.): 100 g/l Ebasolder #10R (based on nonionic surfactant, cationic surfactant, and carboxylic acid derivative, manufactured by Ebara-Udylite Co., Ltd.): 10 ml/l

[Evaluation of Plating Composition, Plating Thickness, Corrosion Resistance, Plating Adhesion, and Disengaging Force Stability of the Plated Ornamental Article]

Plating Thickness:

The cross-section of a plated product was observed on an electron microscope and the thickness of the plating was measured.

Corrosion Resistance:

Corrosion resistance was evaluated based on the degree of discoloration in appearance occurred after standing in a thermo-hygrostat at 60° C. and 98% RH for 20 hours.

○: 5% or less of the surface area was discolored.

Δ: More than 5% and less than 25% of the surface area was discolored.

x: 25% or more of the surface area was discolored.

Plating Adhesion:

Test 1 (Transfer Test)

Samples were strongly rubbed against paper and presence or absence of transfer of the plating on the paper was visually examined and evaluated as follows.

○: Transfer was present.

x: Transfer was absent.

Test 2 (Pincers Peeling Test)

To more strictly evaluate plating adhesion, samples were crushed with a pair of pincers in Test 2 and presence or absence of peeling of the plating at that time was visually evaluated by the following criteria.

○: No peeling of the plating was observed x: Peeling of the plating was observed Disengaging Force Stability:

After brass-made socket members (trade name: 16 Socket (manufactured by YKK Newmax Co., Ltd.)) were plated under the conditions as defined in the respective Examples and Comparative Examples, the respective socket members were attached to individual cloths through fitting members.

Thereafter, engagement and disengagement of the snap buttons (socket and stud) having the same plating were repeatedly performed while measuring disengaging force by a gauge for measuring tensile force each time. The number of times of engagements performed when fluctuation band of the disengaging force as compared with the first disengagement exceeds ±20% or more was defined as limit engagement time whereby the disengaging force stability was evaluated (the greater the limit engagement time, the more excellent the disengaging force stability). Evaluation standards are as follows.

◎: 1,000 times or more

○: 750 times or more and less than 1,000 times

Δ: 500 times or more and less than 750 times x: Less than 500 times

EXAMPLE 1

15 kg of brass-made stud members (trade name: 16 Duo (manufactured by YKK Newmax Co., Ltd.)) were placed in a barrel and immersion degreasing (trade name: ACE CLEAN 5300 (manufactured by Okuno Chemical Industries Co., Ltd.): 60 g/l, 50° C., 12 minutes) and rinsing with water were performed. Thereafter, electrolytic degreasing (trade name: ACE CLEAN 5300 (manufactured by Okuno Chemical Industries Co., Ltd.): 100 g/l, 50° C., 5 V, 12 minutes) and rinsing with water were further performed. Then, the stud members were immersed in a 3.5% hydrochloric acid solution at room temperature for 6 minutes and rinsed with water, and barrel plating was performed in the plating bath (1) at 30° C. at a current density of 0.15 A/dm$^2$ for 24 minutes. After, rinsing with water, the stud members were dried with hot air at 100° C. to obtain plated products of Example 1. The composition of plating, the thickness of the plating, corrosion resistance, adhesion of the plating, disengaging force stability and color tone of the plated products were evaluated and Table 1 shows the results.

EXAMPLE 2

15 kg of brass-made stud members (trade name: 16 Duo (manufactured by YKK Newmax Co., Ltd.)) were placed in a barrel and immersion degreasing (trade name: ACE CLEAN 5300 (manufactured by Okuno Chemical Industries Co., Ltd.): 60 g/l, 50° C., 12 minutes) and rinsing with water were performed. Thereafter, electrolytic degreasing (trade name: ACE CLEAN 5300 (manufactured by Okuno Chemical Industries Co., Ltd.): 100 g/l, 50° C., 5 V, 12 minutes) and rinsing with water were further performed. Then, the stud members were immersed in a 3.5% hydrochloric acid solution at room temperature for 6 minutes and rinsed with water, and barrel plating was performed in the plating bath (1) at 30° C. at a current density of 0.15 A/dm$^2$ for 24 minutes, and rinsing with water was performed. Further, after immersing the stud members again in the 3.5% hydrochloric acid solution at room temperature for 6 minutes, rinsing with water was performed. Then, barrel plating was performed in the plating bath (1) at 30° C. at a current density of 0.15 A/dm$^2$ for 12 minutes, and rinsing with water was performed. After that, the stud members were dried with hot air at 100° C. to obtain plated products of Example 2. The composition of plating, the thickness of the plating, corrosion resistance, adhesion of the plating, disengaging force stability and color tone of the plated products were evaluated and Table 1 shows the results.

EXAMPLE 3 to 15

In the same manner as in Example 1, 15 kg of brass-made stud members (trade name: 16 Duo (manufactured by YKK Newmax Co., Ltd.)) were placed in a barrel and pretreatments were preformed appropriately. Then, the plating bath (1) was adjusted for the concentrations of copper pyrophosphate, tin pyrophosphate, glossing agent and surfactant and barrel plating was performed at varied current density at the time of plating and varied plating time. After rinsing with water, the stud members were dried with hot air at 100° C. to obtain plated products of Examples 3 to 15 with different contents of copper, tin and oxygen in the plating. The composition of plating, the thickness of the plating, corrosion resistance, adhesion of the plating, disengaging force stability and color tone of the plated products were evaluated and Table 1 shows the results.

EXAMPLE 16

15 kg of brass-made stud members (trade name: 16 Duo (manufactured by YKK Newmax Co., Ltd.)) were placed in a barrel and immersion degreasing (trade name: ACE CLEAN 5300 (manufactured by Okuno Chemical Industries Co., Ltd.): 60 g/l, 50° C., 12 minutes) and rinsing with water were performed. Thereafter, electrolytic degreasing (trade name: ACE CLEAN 5300 (manufactured by Okuno Chemical Industries Co., Ltd.): 100 g/l, 50° C., 5 V, 12 minutes) and rinsing with water were further performed. Then, the stud members were immersed in a 3.5% hydrochloric acid solution at room temperature for 6 minutes and rinsed with water, and barrel plating was performed in the plating bath (2) at 30° C. at a current density of 0.15 A/dm$^2$ for 24 minutes, and rinsing with water was performed. Further, after immersing the stud members again in the 3.5% hydrochloric acid solution at room temperature for 6 minutes, rinsing with water was performed. Then, barrel plating was performed in the plating bath (1) at 30° C. at a current density of 0.15 A/dm$^2$ for 12 minutes, and rinsing with water was further performed. After that, the stud members were dried with hot air at 100° C. to obtain plated products of Example 16. The composition of plating, the thickness of the plating, corrosion resistance, adhesion of the plating, disengaging force stability and color tone of the plated products were evaluated and Table 1 shows the results.

EXAMPLE 17

15 kg of brass-made stud members (trade name: 16 Duo (manufactured by YKK Newmax Co., Ltd.)) were placed in a barrel and immersion degreasing (trade name: ACE CLEAN 5300 (manufactured by Okuno Chemical Industries Co., Ltd.): 60 g/l, 50° C., 12 minutes) and rinsing with water were performed. Thereafter, electrolytic degreasing (trade name: ACE CLEAN 5300 (manufactured by Okuno Chemical Industries Co., Ltd.): 100 g/l, 50° C., 5 V, 12 minutes) and rinsing with water were further performed. Then, the stud members were immersed in a 3.5% hydrochloric acid solution at room temperature for 6 minutes and rinsed with water, and barrel plating was performed in the plating bath (4) at 25° C. at a current density of 0.2 A/dm$^2$ for 20 minutes, and rinsing with water was performed. After that, barrel plating was performed in the plating bath (1) at 30° C. at a current density of 0.15 A/dm$^2$ for 12 minutes, followed by rinsing with water. Then, the stud members were dried with hot air at 100° C. to obtain plated products of Example 17. The composition of plating, the thickness of the plating, corrosion resistance, adhesion of the plating, disengaging force stability and color tone of the plated products were evaluated and Table 1 shows the results.

COMPARATIVE EXAMPLE 1

A plated product was obtained in the same manner as in Example 1 except that the plating bath (2) was used to obtain a plated product of Comparative Example 1. The composition, the thickness of the plating, corrosion resistance, adhesion of the plating, disengaging force stability and color tone of the plated products were evaluated and Table 1 shows the results.

COMPARATIVE EXAMPLE 2

A plated product was obtained in the same manner as in Example 1 except that the plating bath (3) was used under conditions of a bath temperature of 50° C., a current density of 0.5 A/dm$^2$ and a plating time of 20 minutes to obtain a plated product of Comparative Example 2 (product equivalent to that of Example 4 of JP 10-102278A). The composition of plating, the thickness of the plating, corrosion resistance, adhesion of the plating, disengaging force stability and color tone of the plated products were evaluated and Table 1 shows the results.

COMPARATIVE EXAMPLE 3

15 kg of brass-made stud members (trade name: 16 Duo (manufactured by YKK Newmax Co., Ltd.)) were placed in a barrel and immersion degreasing (trade name: ACE CLEAN 5300 (manufactured by Okuno Chemical Industries Co., Ltd.): 60 g/l, 50° C., 12 minutes) and rinsing with water were performed. Thereafter, electrolytic degreasing (trade name: ACE CLEAN 5300 (manufactured by Okuno Chemical Industries Co., Ltd.): 100 g/l, 50° C., 5 V, 12 minutes) and rinsing with water were further performed. Then, the stud members were immersed in a 3.5% hydrochloric acid solution at room temperature for 6 minutes and rinsed with water. Thereafter, barrel plating was performed in the plating bath (1) at 30° C. at a current density of 0.15 A/dm$^2$ for 36 minutes, and rinsing with water was performed. Further, after immersing the stud members in an Ebonol C special (manufactured by Meltex Inc., 100° C.) solution for 1 minute, followed by rinsing with water, they were dried with hot air at 100° C. to obtain plated products of Comparative Example 3. The composition of plating, the thickness of the plating, corrosion resistance, adhesion of the plating, disengaging force stability and color tone of the plated products were evaluated and Table 1 shows the results.

TABLE 1

| | | Composition of plating and quality and performance of plated product | | | | | | | | |
|---|---|---|---|---|---|---|---|---|---|---|
| | | Composition of plating | | | | | Adhesion of the plating | | Disengaging | Color |
| | No. | Oxygen (at %) | Copper (at %) | Tin (at %) | Thickness of the plating (μm) | Corrosion resistance | Test 1 | Test 2 | force stability | tone L value |
| Example | 1 | 12 | 70 | 18 | 0.19 | ○ | ○ | ○ | ◎ | ◎ |
| | 2 | 12 | 70 | 18 | 0.32 | ○ | ○ | ○ | ◎ | ◎ |
| | 3 | 13 | 42 | 45 | 0.22 | ○ | ○ | ○ | ◎ | ◎ |
| | 4 | 19 | 22 | 59 | 0.19 | ○ | ○ | ○ | ○ | ◎ |
| | 5 | 7 | 31 | 62 | 0.24 | ○ | ○ | ○ | ○ | ◎ |
| | 6 | 18 | 70 | 12 | 0.21 | Δ | ○ | ○ | ◎ | ◎ |
| | 7 | 6 | 78 | 16 | 0.21 | Δ | ○ | ○ | ◎ | ◎ |
| | 8 | 4 | 63 | 33 | 0.32 | ○ | ○ | ○ | ○ | ○ |
| | 9 | 2 | 72 | 26 | 0.43 | ○ | ○ | ○ | Δ | Δ |
| | 10 | 28 | 56 | 16 | 0.95 | ○ | ○ | ○ | ◎ | ◎ |
| | 11 | 48 | 36 | 16 | 0.43 | ○ | ○ | x | Δ | ◎ |
| | 12 | 12 | 70 | 18 | 10.1 | ○ | ○ | ○ | ◎ | ◎ |
| | 13 | 40 | 40 | 20 | 0.5 | ○ | ○ | ○ | ○ | ◎ |
| | 14 | 27 | 45 | 28 | 1.2 | ○ | ○ | ○ | ◎ | ◎ |
| | 15 | 34 | 43 | 23 | 1.1 | ○ | ○ | ○ | ◎ | ◎ |
| | 16 | 12 | 70 | 18 | 1.3 | ○ | ○ | ○ | ◎ | ◎ |
| | 17 | 12 | 70 | 18 | 3.1 | ○ | ○ | ○ | ◎ | ◎ |
| Comparative Example | 1 | 0 | 70 | 30 | 0.75 | ○ | ○ | ○ | x | x |
| | 2 | 0 | 41 | 59 | 0.23 | Δ | x | x | x | Δ |
| | 3 | 53 | 31 | 16 | 0.21 | x | x | x | Δ | ◎ |

INDUSTRIAL APPLICABILITY

According to the present invention, plating that is (1) nonmagnetic, (2) free of causing metal allergy and (3) excellent in quality and performances such as plating adhesion, disengaging force stability, and corrosion resistance can be obtained. Further, plating that (4) has a blackish color tone without containing any controlled substances can be obtained.

The invention claimed is:

1. An ornamental article having Cu—Sn—O alloy plating having an oxygen content of 0.3 to 50 at % in the plating, wherein said plating is applied to said ornamental article and said ornamental article is made from material selected from a group consisting of metal materials, ceramic materials, plastic materials, or ceramic or plastic materials on which a metal plating has been applied in advance, wherein said ornamental article is a costumery article or a toy.

2. The ornamental article as claimed in claim 1, wherein the oxygen content is 0.5 to 47 at %.

3. The ornamental article as claimed in claim 1, wherein the oxygen content is 1.5 to 50 at % and the plating has blackish appearance.

4. The ornamental article as claimed in claim 1, wherein a copper content is 20 to 80 at %, and a tin content is 10 to 70 at % in the plating.

5. The ornamental article as claimed in claim 2, wherein a copper content is 20 to 80 at %, and a tin content is 10 to 70 at % in the plating.

6. The ornamental article as claimed in claim 3, wherein a copper content is 20 to 80 at %, and a tin content is 10 to 70 at % in the plating.

7. The ornamental article as claimed in claim 2, wherein the costumery article is a snap button.

8. The ornamental article as claimed in claim 3, wherein the costumery article is a snap button.

9. The ornamental article as claimed in claim 4, wherein the costumery article is a snap button.

10. The ornamental article as claimed in claim 5, wherein the costumery article is a snap button.

11. The ornamental article according to claim 1, wherein the costumery article is an article for clothing or an accessory for said clothing.

12. The ornamental article according to claim 11, wherein the costumery article comprises a button, a buckle, a slide fastener, a cuff button, or a jewelry article.

13. An ornamental article having Cu—Sn—O alloy plating having an oxygen content of 0.3 to 50 at % in the plating, wherein said plating is applied to said ornamental article and said ornamental article is made from material selected from a group consisting of metal materials, ceramic materials, plastic materials, or ceramic or plastic materials on which a metal plating has been applied in advance, wherein said ornamental article is a snap button.

* * * * *